US006006061A

United States Patent [19]

Liu et al.

[11] Patent Number: 6,006,061

[45] Date of Patent: Dec. 21, 1999

[54] METHOD AND APPARATUS FOR FORMING HIGH QUALITY IMAGES IN AN ELECTROSTATIC PRINTING MACHINE

[75] Inventors: Chu-Heng Liu, Penfield; Weizhong Zhao, Webster, both of N.Y.

[73] Assignee: Xerox Corporation, Stamford, Conn.

[21] Appl. No.: 09/184,674

[22] Filed: Nov. 2, 1998

[51] Int. Cl.[6] ..... G03G 15/16

[52] U.S. Cl. ..... 399/296; 399/237

[58] Field of Search ..... 399/127–129, 399/296, 237

[56] References Cited

U.S. PATENT DOCUMENTS

| | | | |
|---|---|---|---|
| 4,482,240 | 11/1984 | Kuge et al. | 399/296 |
| 5,387,760 | 2/1995 | Miyazawa et al. . | |
| 5,406,359 | 4/1995 | Fletcher | 399/296 |
| 5,436,706 | 7/1995 | Landa et al. . | |
| 5,619,313 | 4/1997 | Domoto et al. | 399/233 |
| 5,713,064 | 1/1998 | Kasike et al. | 399/296 X |
| 5,826,147 | 10/1998 | Liu et al. | 399/237 |
| 5,835,826 | 11/1998 | Okada et al. | 399/296 X |
| 5,893,664 | 4/1999 | Kumasaka et al. | 399/296 |
| 5,937,248 | 8/1999 | Liu et al. | 399/237 |

*Primary Examiner*—Matthew S. Smith
*Attorney, Agent, or Firm*—Tallam I. Nguti

[57] ABSTRACT

A method and apparatus for producing high quality toner images in an electrostatic printing machine. The method using the apparatus includes (a) forming an initial developed toner image on a photoreceptor using initial developed toner image forming assemblies including a first charging device for uniformly charging the photoreceptor, and a development assembly including charged toner solids having a single charge polarity; and (b) refining the initial developed toner image using reverse charge printing (RCP) assemblies including a second charging device for reversing charge polarity on unwanted toner solids in background areas of the initial developed toner image, and for removing such unwanted toner solids from such background areas, thereby producing a high quality final toner image having sharp image area edges and highly clean background areas.

7 Claims, 2 Drawing Sheets

METHOD AND APPARATUS FOR FORMING HIGH QUALITY IMAGES IN AN ELECTROSTATIC PRINTING MACHINE

This invention relates generally to electrostatography, and more particularly, concerns a method and apparatus for forming high quality images in an electrostatic printing machine.

Generally, processes for electrostatographic copying and printing are initiated by selectively charging and/or discharging a charge receptive imaging member in accordance with an original input document or an imaging signal, generating an electrostatic latent image on the imaging member. This latent image is subsequently developed into a visible image by a process in which charged developing material is deposited onto the surface of the latent image bearing member, wherein charged solids in the developing material adhere to image areas of the latent image. The developing material typically comprises carrier granules having charged marking or toner solids adhering triboelectrically thereto, wherein the toner solids are electrostatically attracted from the carrier granules to the latent image areas to create a powder toner image on the imaging member.

Alternatively, the developing material may comprise a liquid developing material comprising a carrier liquid having pigmented marking solids (or so-called toner solids) and charge director materials dispersed and/or dissolved therein (so-called carrier liquid), wherein the liquid developing material is applied to the latent image bearing imaging member with the marking solids being attracted to the image areas of the latent image to form a developed liquid toner image. Regardless of the type of developing material employed, the charged toner or marking solids of the developing material are electrostatically attracted to the latent image to form a visible developed image corresponding to the latent image on the imaging member.

The developed image is subsequently transferred, either directly or indirectly, from the imaging member to a copy substrate, such as paper or the like, to produce a "hard copy" output document. In a final step, the imaging member is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface. It will be understood that the instant invention applies to all various types of electrostatic printing systems and is not intended to be limited by the manner in which the image is formed on the imaging member or the nature of the latent image bearing member itself.

As described hereinabove, the typical electrostatographic printing process includes a conventional development step whereby developing material including charged marking or toner solids is physically transported into contact with the imaging member so as to selectively adhere to the latent image areas thereon in an image-wise configuration. Development of the latent image is usually accomplished by electrical attraction of charged toner or marking solids to the image areas of the latent image. The development process is most effectively accomplished when the solids carry electrical charges opposite in polarity to the latent image charges, with the amount of toner or marking solids attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

The following disclosures may be relevant to some aspects of the present invention. U.S. Pat. No. 5,387,760 discloses a wet development apparatus for use in a recording machine to develop a latent image on a uniformly charged imaging carrier member toner image. The apparatus includes a development roller disposed in contact with or near the electrostatic latent image carrier and an application head for applying a uniform layer of the wet developer to the roller.

U.S. Pat. No. 5,436,706 discloses an liquid immersion development (LID) machine including a first member having a uniformly charged first surface having formed thereon a latent electrostatic image, wherein the latent electrostatic image includes image regions at a first voltage and background regions at a second voltage. A second member charged to a third voltage intermediate the first and second voltages is also provided, having a second surface adapted for resilient engagement with the first surface. A third member is provided, adapted for resilient contact with the second surface in a transfer region. The liquid immersion development (LID) machine also includes an apparatus for supplying liquid toner to the transfer region thereby forming on the second surface a thin layer of liquid toner containing a relatively high concentration of charged toner solids, as well as an apparatus for developing the latent image by selective transferring portions of the layer of liquid toner from the second surface to the first surface.

U.S. Pat. No. 5,619,313 discloses a method and apparatus for simultaneously developing and transferring a liquid toner image. The method includes the steps of moving a photoreceptor including a charge bearing surface having a first electrical potential, applying a uniform layer of charge having a second electrical potential onto the charge bearing surface, and image-wise dissipating charge from selected portions on the uniformly charged charge bearing surface to form a latent image electrostatically, such that the charge-dissipated portions of the charge bearing surface have the first electrical potential of the charge bearing surface. The method also includes the steps of moving an intermediate transfer member biased to a third electrical potential that lies between said first and said second potentials, into a nip forming relationship with the moving imaging member to form a process nip. The method further includes the step of introducing charged liquid toner having a fourth electrical potential into the process nip, such that the liquid toner sandwiched within the nip simultaneously develops image portions of the latent image onto the intermediate transfer member, and background portions of the latent image onto the charge bearing surface of the photoreceptor.

Image quality is a concern with all electrostatographic printing applications or toner image forming methods including the conventional exemplary methods discussed above. In such methods, image quality in electrostatographic printing applications may vary significantly and unacceptably due to numerous conditions affecting latent image formation as well as development, among various other factors. In particular, image development can be effected by charge levels, both in the latent image, as well as in the developing material. For example, when the charge on dry toner solids becomes significantly depleted, binding forces with the carrier also become depleted, causing an undesirable increase in image development, which, in turn, causes the development of the latent image to spread beyond the area defined thereby. The unacceptable result is often unwanted toner solids in background or non-image areas.

Costly and high precision charging and development devices are often not desirable solutions to unacceptable image quality. There is therefore, for example, an ongoing need for a method and apparatus in an electrostatic printing machine for forming high quality toner images that do not have poor quality backgrounds.

SUMMARY OF THE INVENTION

In accordance with one aspect of the present invention, there is provided a method of producing high quality toner images in an electrostatic printing machine. The method includes (a) forming an initial developed toner image on a photoreceptor using initial developed toner image forming assemblies including a first charging device for uniformly charging the photoreceptor, and a development assembly containing charged toner solids having a single charge polarity; and (b) refining the initial developed toner image using reverse charge printing (RCP) assemblies including a second charging device for reversing charge polarity on unwanted toner solids in background areas of the initial developed toner image, and for removing such unwanted toner solids from such background areas, thereby producing a high quality final toner image having sharp image area edges and highly clean background areas.

In accordance with another aspect of the present invention, there is provided an electrostatic printing machine for producing high quality toner images. The electrostatic printing machine comprises a movable photoreceptor having an image bearing photoconductive surface, and a first stage series of toner image forming assemblies including a first charging device for first uniformly charging the image bearing photoconductive surface, a first exposure device for first image-wise exposing the charged photoconductive surface to form a latent image having image areas and background areas, and a contact development apparatus including developer material having charged toner solids therein for contacting the latent image to image-wise develop it into an initial developed toner image having the image areas and some undesirable toner solids in the background areas. The electrostatic printing machine also comprises a second stage series of toner image refining assemblies, including a second charging device for recharging the initial developed toner image by introducing free mobile charges into the vicinity of the initial developed toner image such that the initial developed toner image causes the free mobile charges to flow in an image-wise charge stream corresponding to the image areas and background areas, and an intermediate transfer member forming a separation nip with the image bearing photoconductive surface for separating the recharged background toner solids from the recharged developed image areas, thereby producing a relatively high quality toner solids image having no background deposits.

BRIEF DESCRIPTION OF THE DRAWINGS

These and other aspects of the present invention will become apparent from the following description in conjunction with the accompanying drawings in which.

DETAILED DESCRIPTION OF THE INVENTION

Figure 1:
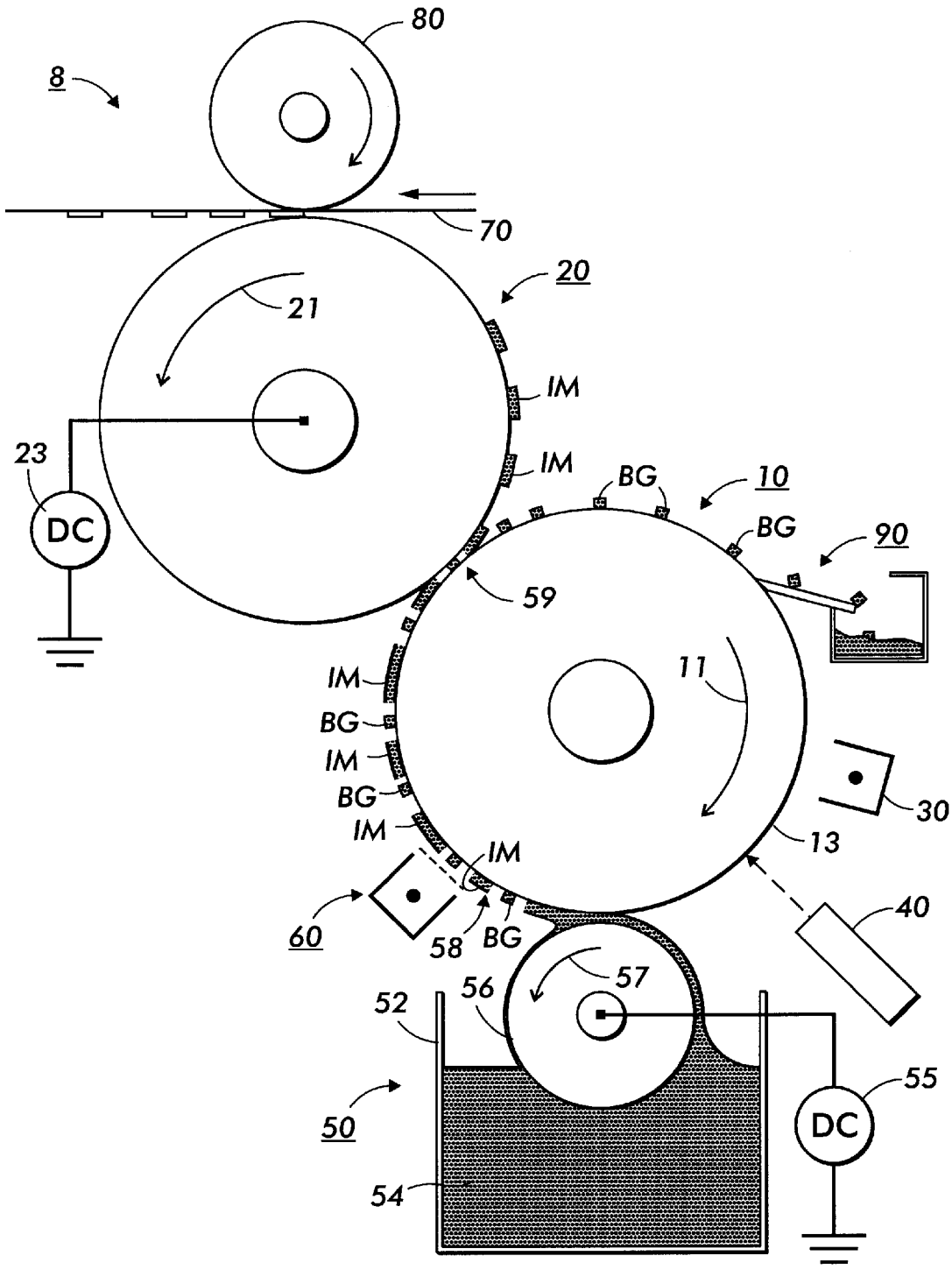
FIG. 1 is a schematic illustration of the liquid immersion development (LID) machine in accordance with the present invention, including a first series of toner image forming assemblies, and a second stage series of reverse charge printing (RCP) assemblies for refining the initial developed toner image to produce a high quality liquid toner image in accordance with the present invention.

For a general understanding of the features of the present invention, reference is made to the drawings, wherein like reference numerals have been used throughout to identify the same or similar elements. Although the following description will be directed to a liquid immersion development (LID) machine, it will be understood that the present invention contemplates the use of various alternative embodiments for the initial development of a toner image, as are well known in the art of electrostatographic copying and printing, including, for example, but not limited to, liquid toner development and dry toner development. On the contrary, the following description is intended to cover all alternatives, modifications, and equivalents, as may be included within the spirit and scope of the invention as defined by the appended claims.

Referring now to FIG. 1, the liquid immersion development (LID) machine of the present invention for forming relatively high quality toner images in accordance with the present invention is shown generally as 8. As shown, the LID machine 8 includes a first stage series of assemblies of operatively associated image forming and refining elements in accordance with the present invention, including an imaging member 10. Imaging member 10 includes an imaging surface 13 of any type capable of having an electrostatic latent image formed thereon. An exemplary imaging member 10 may include a typical photoconductor or other photoreceptive component of the type known to those of skill in the art in electrophotography, wherein an imageable surface having photoconductive properties is supported on a conductive support substrate.

Although the following description will be directed to a photoconductive imaging member, it will be understood that the present invention contemplates the use of various alternative embodiments for an imaging member as are well known in the art of electrostatographic printing, including, for example, but not limited to, non25 photosensitive imaging members such as a dielectric charge retaining member of the type used in ionographic printing machines, or electroded substructures capable of generating charged latent images.

Photoreceptor 10 is rotated, as indicated by arrow 11, so as to transport the surface 13 thereof in a process direction for implementing first stage and second stage series of image forming and refining steps in accordance with the present invention.

Initially, as shown in FIG. 1, the photoconductive surface 13 of photoreceptor 10 passes through a series of initial toner image forming assemblies including a first charging assembly 30, an exposure assembly 40 and a development assembly 50, for forming an initial developed toner image 58. The first charging assembly may include a corona generating device 30 or any other charging apparatus for applying an electrostatic charge to the surface of the photoreceptor 10. The corona generating device 30 is provided for charging the photoconductive surface of photoreceptor 10 to a relatively high, substantially uniform potential. It will be understood that various charging devices, such as charge rollers, charge brushes and the like, as well as induction and semiconductive charge devices among other devices which are well known in the art may be utilized at the charging assembly for uniformly applying a charge potential to the surface of the photoreceptor 10.

After the photoreceptor 10 is brought to a substantially uniform charge potential, the charged surface 13 thereof is advanced to an image exposure assembly, identified generally by reference numeral 40. The image exposure assembly 40 projects a light image corresponding to an input image, to be reproduced, onto the charged photoconductive surface. The light image selectively dissipates the charge in portions thereof for recording a first latent image on the photoconductive surface in image configuration corresponding to the input image. The first latent image thus includes image areas having a first charge voltage, and background areas having a second charge voltage.

The image exposure assembly 40 may incorporate various optical image formation and projection components as are known in the art. For example, it may include various well known light lens apparatus or digital scanning systems for forming and projecting an image from an original input document onto the photoreceptor 10. Alternatively, various other electronic devices available in the art may be utilized for generating electronic information to create the electrostatic latent image on the imaging member.

The photoreceptor 10 then moves the first latent image on its surface to a conventional development assembly 50 where both the image areas and background areas of the latent image are contacted with liquid developer material 54 so as to develop or make the first latent image visible with charged toner solids contained in the liquid developer material 54. As shown, the development assembly 50 includes a housing 52 that holds the liquid developer material 54 containing charged toner solids. The assembly 50 includes an applicator roll 56 that is biased by a source 55 for causing image-wise development or toner solids transfer from the applicator 56 to the first latent image on photoreceptor 10. The electrical bias from the source 55 is of a magnitude intended to cause toner solids to be transported from the applicator 56 to image areas of the first latent image, but ordinarily not to the background areas thereof, however some toner solids do undesirably transfer to background areas.

Importantly, the toner solids are charged so they have a toner potential that is suitable for neutralizing, only partially, the charge in the image areas being developed. For example, where the image areas being developed were charged to +800 v and remain at +800 v after exposure to dissipate background areas to zero volts, a suitable voltage or potential for the toner solids will be −400 v. The −400 v toner solids when developed onto the +800 v image area, will partially reduce the image area voltage to +400 v, a 50% partially neutralization. The +400 v is the residual potential between image areas and background areas at zero volts.

As shown, the applicator roll 56 rotates in the direction of the arrow 57 and transports a layer of the developer material 54 into contact with the first latent image on the surface of the photoreceptor 10. The latent image is thus developed as such by selectively attracting the charged toner solids onto image areas of the latent image to form an initial developed toner image 58 having wanted toner solids IM in image areas of the latent image, and some unwanted toner solids BG in background areas thereof.

The unwanted toner solids BG in the background areas of course represent poor or unacceptable image quality, as discussed for example in the background portion of this specification. In accordance with an aspect of the present invention, such poor image quality may be arrived at intentionally by using less costly, low latitude first stage series of assemblies 40, 50 as above., for forming the initial developed toner image. Ordinarily however, such poor image quality results from conventional initial developed toner image forming methods, particularly from conventional development methods as carried out with the development assembly 50.

As pointed out in the background portion of this specification, image quality concerns and problems are due to numerous conditions arising, for example, from latent image formation at the exposure assembly 40, and in particular from toner development at the development assembly 50. The predictably poor or relatively low quality result usually is the transfer or development of unwanted toner solids BG onto the background areas of the first latent image when the entire latent image (image areas and background areas thereof) is contacted, as above, with developer material by the development assembly 50. If the initial developed toner image 58 (image areas and background areas) to be transferred as such unrefined, onto a sheet of paper, it will clearly and undesirably include on such sheet of paper, such unwanted toner solids BG in the background areas.

However, in accordance with the present invention, any unwanted toner solids BG in background areas will be removed or significantly reduced by the second stage series of toner image refining assemblies or reverse charge printing (RCP) assemblies, that are mounted downstream of the development apparatus 50. In addition, other image defects known as edge smearing due to toner spreading over the image-background boundary onto the background area, such as dragout in liquid immersion development, will be significantly reduced or eliminated, advantageously resulting in high resolution and sharp edges for wanted toner solids in image areas of the final toner image, even if the initial developed toner image was only an ordinary low latitude developed toner image having significant unwanted background toner solids BG.

Figure 2:
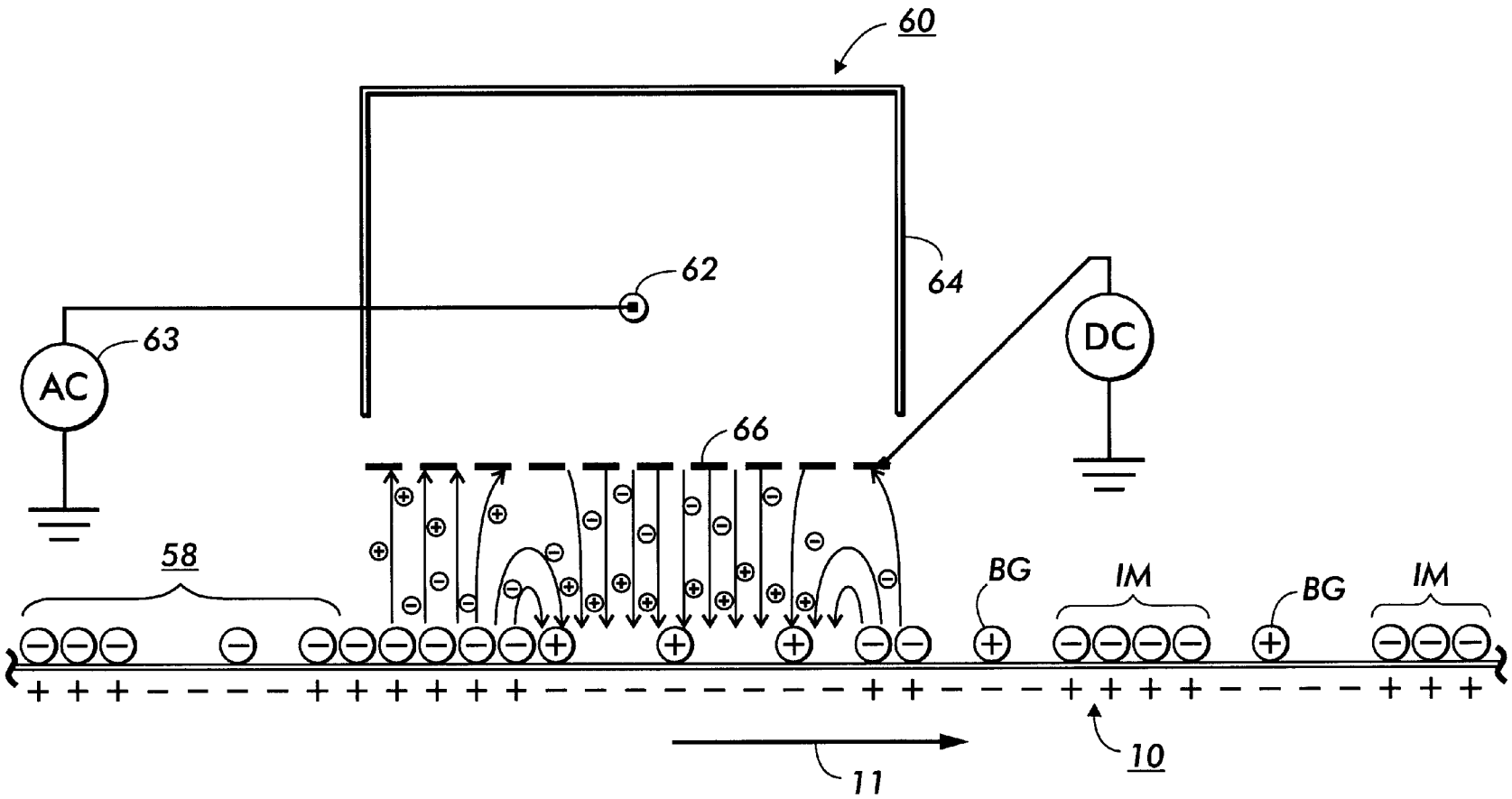
FIG. 2 is an exploded view illustrating the recharging device of the second stage RCP assemblies of FIG. 1 and the process of image-wise recharging of the initial developed toner image.

Referring now to FIGS. 1 and 2, the second, RCP recharging device of the second stage series of toner image refining assemblies of the present invention, is illustrated. Method and apparatus for RCP (Reverse Charge Printing) as a primary, first stage method and an apparatus for forming an initial developed toner image are disclosed for example in U.S. application Ser. No. 08/883,292 in the name of the current inventors, (relevant parts of which are incorporated herein by reference). As disclosed therein, RCP employs latent image formation, uniform, non-image toner layer coating, a charging or an ion generating device for producing positive or negative ions for image-wise application to background areas and image areas of the coated latent image, and a separation roll.

Such selective application of charges to the uniform layer of toner solids uniformly coating all areas of the latent image, advantageously reverses charge on toner solids coating background areas of the latent image. Such reverse charging of toner solids in background areas effectively enables the separation roll to selectively remove toner solids either from the image areas or from the background areas, depending on the bias on the separation roll, thus leaving an initial developed toner image on the other surface.

Accordingly therefore, after the initial developed toner image 58 is formed on the surface of the photoreceptor 10, such initial developed toner image is then recharged in an image-wise manner in the second stage of the present invention by a second charging device 60 of the RCP assemblies 60 and 80. The second charging device 60 can be a well known scorotron device that is used herein for producing an image-wise stream of free mobile ions in the vicinity of the initial developed toner image on the surface of the photoreceptor 10. The second charging device includes a DC biasing source coupled thereto for providing a biasing voltage thereto to generate ions having a single charge polarity. The image-wise ion stream forms a secondary latent image in the initial developed toner image that in effect reverses the charge on toner solids in only the background areas, resulting in oppositely charged toner solids in image areas as compared to background areas.

For the second stage of the present invention involving the refining of the initial developed toner image, the RCP process of forming a secondary latent image in the initial developed toner image 58 will be described in greater detail with respect to FIG. 2. In FIG. 2, the image-wise developed toner image 58 is illustrated, for purposes of simplicity only, as having image areas consisting of a uniformly distributed layer of negatively charged toner solids IM, and undeveloped background areas having some undesired toner solids BG deposited therein. The initial developed toner image 58 as such resides on the surface of the photoreceptor 10 which is being transported from left to right past the second charging device 60. As previously described, the primary function of the second charging device 60 is to provide free mobile ions, of a desired polarity, in the vicinity of the initial developed toner image 58 on the photoreceptor 10.

In one respect, the second stage RCP assemblies 60, 80 amount to a second image forming process (image-wise charging of a toner solids pattern and separation thereof into image areas and background areas), after conventional latent image formation and toner development thereof on a photoreceptor. This second image forming process is for the purpose of refining the conventionally formed initial developed toner image. As a result, any image defects such as undesired or unwanted toner solids in background areas are effectively removed, and are not transferred along with the desired initial developed toner image areas at the separation nip. As such, image defects such as high background and drag-out (LID) are completely cured or substantially cured. The final results include high resolution and sharp edges restored to the image areas despite the initial image forming defects of the initial conventional development step. Because of the capability of restoring high resolution to otherwise low quality, conventionally developed initial developed toner images, this image-wise recharging and refining step thus greatly reduces the need for high or tight constraints on the initial conventional development step of the present invention.

Specifically, as shown in FIG. 2, the scorotron device 60 includes a corona generating electrode 62 enclosed within a shield member 64 surrounding the electrode 62 on three sides. A wire grid 66 covers the open side of the shield member 64 facing the photoreceptor 10.

In operation, the corona generating electrode 62, otherwise known as a coronode, is coupled to an electrical biasing source 63 capable of providing a relatively high voltage potential to the coronode, which causes electrostatic fields to develop between the coronode 62 and the grid and the photoreceptor 10. The force of these fields causes the air immediately surrounding the coronode to become ionized, generating free mobile ions which are repelled from the coronode toward the grid 66 and the photoreceptor 10. As is well known to one of skill in the art, the scorotron grid 66 is biased so as to be operative to control the amount of charge and the charge uniformity applied to the imaging surface 10 by controlling the flow of ions through the electrical field formed between the grid and the imaging surface.

The function of the charging device 60 is to recharge the initial developed toner image 58 in an image-wise manner. This process is illustrated with respect to an initial developed toner image 58 formed with negatively charged toner solids, although it will be understood that the process can also be implemented using positively charged toner solids. The process of the present invention requires that the second charging device 60 produce ions having a charge opposite that of the toner solids forming the initial developed toner image 58. On the other hand, the oppositely charged ions should be prevented from reaching the image area. Thus, as shown in FIG. 2, the scorotron 60 is preferably provided with an energizing bias at grid 66 intermediate the potential of the image areas and that of the background areas of the image 58 on the photoreceptor 10.

Under certain circumstances, such as when the charge on the toner solids is sufficient to prevent charge reversal due to injected wrong sign charge, the energizing bias at the grid 66 can be higher or lower than the bias of the image areas and the background areas of the image. In addition, the energizing bias applied to grid 66 can be provided in the form of either a direct current (DC) electrical bias or an alternating current (AC) bias having a DC offset.

Operatively, in areas where a portion of the initial developed toner image 58 is at a potential which is lower than the intermediate bias potential 63 of the charging source grid 66, the result is a set of electrostatic field lines (as shown by the arrow ends) directed toward the photoreceptor 10, and thus toward the initial developed toner image 58 thereon. Conversely however, the result is a set of electrostatic field lines that are generated in a direction away from the photoreceptor 10, and hence away from the initial developed toner image 58 thereon, in areas of the image 58 where the potential is higher than the intermediate bias potential 63 of the charging source grid 66.

FIG. 2 further illustrates the effect of the field lines in the case of the second charging device 60 being energized by an AC voltage having a DC grid bias 66 voltage that is intermediate to the image and background areas of the developed image 58, represented by (+) and (−) signs, respectively, on the back side of the photoreceptor 10. As illustrated, positive ions flow from the second charging device 60 in the direction of the field lines towards the toner solids IM, BG, forming the initial developed toner image 58, while negative ions (electrons) flow in a direction opposite to the direction of the field lines. As a consequence, the positive ions in the vicinity of a positively charged area (image area, given negative toner) of the photoreceptor 10, as shown, are repelled from the photoreceptor 10, and hence from any toner solids (IM) forming the image portions of the initial developed toner image 58 thereon. At the same time, positive ions in the vicinity of a negatively charged area of the photoreceptor 10 are attracted to the photoreceptor 10, and hence to any toner solids(BG) forming the background portions of the initial developed toner image 58 thereon.

Conversely however, negative ions in the vicinity of a toner developed positively charged area (image area, given negative toner) of the photoreceptor 10 are attracted to the photoreceptor 10 and are absorbed into the negatively charged toner solids of the image 58, thereby increasing the negative charge levels in that background area. On the other hand, the negative ions in the vicinity of a background, undeveloped negatively charged area of the latent image are repelled from such background area and any toner deposits BG in such area The free flowing ions generated by the second charging device 60 are thus captured by the image 58 in an image-wise manner corresponding to the developed toner image 58 on the photoreceptor 10, thereby causing image-wise recharging of the image 58. This creates a secondary latent image within the image 58 that is charged oppositely in polarity to the charge of the original latent image now developed into image 58. Under optimum conditions, the charge associated with said original latent image will be captured and converted into the secondary latent image, in the image 58 such that the original first latent image is substantially or completely dissipated into the recharged image 58.

In order to achieve good image refining, a strong image-wise force is required. Therefore, a strong image-wise field is desired. As will be understood, the latent image contrast is the origin of the image-wise field, substantial residual latent image contrast after the initial toner image development must remain to enable the image refining process. Therefore after formation of the initial developed toner image 58, substantial residual potential difference or contrast must exist between the image areas IM and background areas of the image 58. It is preferable that such a residual potential difference or contrast have an absolute magnitude of plus or minus 200 v, and should be greater than one-third of the original or latent image potential contrast, (that is the difference between the potential of the charged and discharged areas of the first latent image). In addition, it is also preferable that the residual potential contrast should be less than two-thirds of that original potential contrast in order to facilitate the second stage refining step of the present invention. This is in distinct contrast to conventional development processes in which an original, latent image potential contrast or difference in charge levels between charged and discharged areas usually is completely neutralized when charged toners reduce or increase the potential of the image areas so that they then equal that of background areas.

Due to the process latitude provided by the image refining process, the initial image development can operate in such a way to maximize the system performance. Conventionally, high speed development is difficult to achieve due to the limited toner mobility and development field. The great tolerance acceptable for forming of the initial developed toner image 58 in accordance with the current invention advantageously enables much greater development field and faster development. Even though the background quality and drag-out (as in liquid immersion development) are comparatively worse in the first stage, the second stage image refining process cures most of such image defects, and enables high speed development.

To summarize, in conventional development, as practiced at 50 (FIG. 1) in the first initial stage of the present invention, there are always some image defects such as unwanted toner solids BG in background areas. Additionally, such defects for example include high background and drag-out (in LID). Typically, a lot of effort and cost are spent towards minimizing such defects, and as a result, the development apparatus and process latitudes are often required to be very tight. Because the effects of such defects are often cumulative, the developed or initial developed toner image is typically substantially worse in resolution than the latent image from which it is developed or toned. Thus in accordance to the present invention, what amount to two development processes or stages (initial toner image development, and RCP toner image refining) are provided for first forming a low quality initial developed toner image conventionally, and then subsequently processing or refining the low quality initial developed toner image into a high resolution, high quality final toner image.

In the second stage, toner solids in image areas and toner solids in background areas are treated differently in an image-wise manner in order to obtain opposite charge polarities therebetween before a separation step where toner solids in the image areas (IM) are separated in a two surface nip onto one surface, from toner solids in the background areas.

Thus in accordance with the present invention, in its initial development process or stage, a latent image formed image-wise on the photoreceptor 10 is first developed conventionally using a development apparatus 50. The result, a conventional developed or initial developed toner image 58 typically has toned image areas IM, and substantial image defects such as unwanted toner solids BG in the background areas.

The first stage is carried out so that after such conventional development, a substantial voltage difference or contrast remains between the voltage or potential of toned or developed image areas (IM) and the potential or voltage of the background areas. In the second process or toned image refining stage, this remaining voltage difference or contrast is effectively relied on and used in an image-wise recharging step for reversing the charge on toner solids BG in the background areas. As a result of this recharging step, the polarity of toner solids BG in background areas is reversed, and thus such toner solids BG are substantially unlikely to transfer along with toner solids (IM) in image areas. As a consequence, the transferred refined toner image areas IM have sharp edges, relatively higher resolution and highly clean background areas.

Once the secondary latent image is formed in the initial developed toner image, the latent image bearing initial developed toner image is advanced to the image separator 20. Referring back to FIG. 1, image separator 20 may be provided in the form of a biased roll member having a surface adjacent to the surface of the photoreceptor 10 and preferably contacting the initial developed toner image 58 residing on photoreceptor 10. An electrical biasing source is coupled to the image separator 20 to bias the image separator 20 so as to attract either image or non-image or background areas of the latent image formed in the initial developed toner image 58 for simultaneously separating and developing the initial developed toner image 58 into image and non-image or background portions. In the embodiment of FIG. 1, the image separator 20 is biased with a polarity opposite the charge polarity of the image areas in the initial developed toner image 58 for attracting image areas therefrom, thereby producing a developed image made up of selectively separated and transferred portions of the initial developed toner image on the surface of the image separator 20, while leaving background image byproduct on the surface of the photoreceptor 10. Alternatively, the image separator 20 can be provided with an electrical bias having a polarity appropriate for attracting non-image or background areas away from the photoreceptor 10, thereby maintaining toner portions corresponding to image areas on the surface of the imaging member, yielding a developed image thereon, while removing non-image or background or background areas with the image separator 20.

The separation roll or separator 20 can also function as an image conditioning device for removing excess carrier liquid from the initial developed toner image developed with liquid developer material consisting of toner solids and such carrier liquid. Use of the reverse charge printing assembly to refine initial developed initial developed toner images greatly reduces the need for tight and costly constraints on the development apparatus, constraints that would otherwise have been necessary for producing refined initial developed toner images by itself without subsequent refining.

After the developed image is created, either on the surface of the photoreceptor 10 or on the surface of the imaging separator 20, the developed image may then be transferred to a copy substrate 70 via any means known in the art, which may include an electrostatic transfer apparatus including a corona generating device of the type previously described or a biased transfer roll. Alternatively, a pressure transfer system may be employed which may include a heating and/or chemical application device for assisting in the pressure transfer and fixing of the developed image on the output copy substrate 70. In yet another alternative, image transfer can be accomplished via surface energy differentials wherein the surface energy between the image and the member supporting the image prior to transfer is lower than the surface energy between the image and the substrate 70, inducing transfer thereto.

In a preferred embodiment, as shown in FIG. 1, the image is transferred to a copy substrate via a heated pressure roll, whereby pressure and heat are simultaneously applied to the image to simultaneously transfer and fuse the image to the copy substrate 70. It will be understood that separate transfer and fusing systems may be provided, wherein the fusing or so-called fixing system may operate using heat (by any means such as radiation, convection, conduction, induction, etc.), or other known fixation process which may include the introduction of a chemical fixing agent. Since the art of electrostatographic printing is well known, it is noted that several concepts for transfer and/or fusing which could be beneficially used in combination with the image-wise charging system of the present invention have been disclosed in the relevant patent literature.

In a final step in the process the background image byproduct on either the photoreceptor 10 or the image separator 20 is removed from the surface thereof in order to clean the surface in preparation for a subsequent imaging cycle. FIG. 1 illustrates a simple blade cleaning device 90 apparatus for scraping the imaging member surface as is well known in the art. Alternative embodiments may include a brush or roller member for removing toner from the surface on which it resides. In a preferred embodiment the removed toner associated with the background image is transported to a toner sump or other reclaim vessel so that the waste toner can be recycled and used again to produce the initial developed toner image in subsequent imaging cycles.

It is, therefore, evident that there has been provided, in accordance with the present invention a high resolution, high quality toner image producing method and apparatus that fully satisfy the aspects of the invention hereinbefore set forth. While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. An electrostatic printing machine, for producing high resolution, high quality toner images, the electrostatic machine comprising:

(a) a photoreceptor having a photoconductive surface capable of supporting marking material;

(b) a first charging device for applying a uniform layer of charge on said photoconductive surface of said photoreceptor to produce a charged surface;

(c) an exposing device for image-wise exposing portions of said charged surface to form a first latent image including image areas to be developed having a first charge level, background areas having a second charge level, and an original potential contrast between said first charge level and said second charge level;

(d) a development apparatus including developer material containing charged toner solids for contacting said image areas to be developed and said background areas of said first latent image, and for image-wise forming an initial developed toner image including image areas having wanted toner solids and background areas having some unwanted toner solids therein, said charged toner solids having a potential suitable for partially neutralizing potential in said image areas so as to result in a residual potential contrast between image areas and background areas that is less than two-thirds of said original potential contrast;

(e) a second charging device for selectively delivering charges to the toner solids forming said initial developed toner image in an image-wise manner responsive to said first latent image on said photoreceptor so as to reverse charge polarity on unwanted toner solids in said background areas of said initial developed toner image; and (f) a separator member for selectively separating wanted toner solids forming image areas of said initial developed toner image from said recharged toner solids in said background areas thereof, thereby producing a high quality final toner image having sharp image area edges and highly clean background areas.

2. The electrostatic printing machine of claim 1, wherein said second charging device is adapted to introduce an image-wise ion stream of free mobile ions directed toward toner solids in said image areas and said background areas of said initial developed toner image on said photoreceptor, responsive to said first latent image on said photoreceptor.

3. The electrostatic printing machine of claim 1, wherein said second charging device includes a DC biasing source coupled thereto for providing a biasing voltage to said second charging device to generate ions having a single charge polarity.

4. The electrostatic printing machine of claim 1, wherein in a charged area development (CAD) process said second charging device includes an electrical biasing source coupled to an electrode member for providing a biasing voltage greater than background area voltage and less than the image area voltage of said first latent image.

5. A method for producing high quality toner images in an electrostatic printing machine, the method, comprising the steps of:

(a) using a charging device to uniformly charge a photoconductive surface of a moving photoreceptor;

(b) image-wise exposing said photoconductive surface to generate a latent image thereon, said latent image including image areas having a first charge potential, background areas having a second and different charge potential, and an original potential contrast between the image areas and the background areas of the latent image;

(c) image-wise developing said latent image by contacting both image areas and background areas of said latent image with developer material containing charged toner solids to form an initial developed toner image having some unwanted toner solids in said background areas, the charged toner solids having a voltage suitable for partially neutralizing potential in the image areas so as to result in a residual potential contrast between image areas and background areas that is less than two-thirds of the original potential contrast;

(d) image-wise recharging the initial developed toner image in a manner responsive to the first latent image on the photoreceptor by using a second charging device to selectively deliver a stream of ions to the toner solids in the image areas and background areas of the initial developed toner image, thereby reversing a charge polarity on unwanted toner solids in the background areas; and (e) selectively separating wanted toner solids forming image areas of the initial developed toner image from the recharged toner solids in the background areas thereof, thereby producing a high quality final toner image having sharp image area edges and highly clean background area.

6. The method of claim 5, wherein said image-wise developing step includes using developer material containing charged toner solids having a potential suitable for partially neutralizing potential in image areas so as to result in a residual potential contrast of about 200 v between developed image areas and undeveloped background areas of the initial developed toner image.

7. The method of claim 5, wherein said image-wise developing step includes using developer material containing charged toner solids having a potential suitable for partially neutralizing potential in image areas so as to result in a residual potential contrast that is greater than one-third of an original potential contrast between image areas to be developed and background areas of the latent image being developed into the initial developed toner image.

* * * * *